United States Patent [19]

Bauman

[11] Patent Number: 4,626,364

[45] **Date of Patent: * Dec. 2, 1986**

[54] PARTICULATE FABRIC SOFTENING AND ANTISTATIC BUILT DETERGENT COMPOSITION AND PARTICULATE AGGLOMERATE FOR USE IN MANUFACTURE THEREOF

[75] Inventor: Robert A. Bauman, New Brunswick, N.J.

[73] Assignee: Colgate-Palmolive Company, New York, N.Y.

[ * ] Notice: The portion of the term of this patent subsequent to Feb. 5, 2002 has been disclaimed.

[21] Appl. No.: 695,157

[22] Filed: Jan. 28, 1985

[51] Int. Cl.[4] ..... D06M 11/00

[52] U.S. Cl. ..... 252/8.8; 252/8.6; 252/174.25

[58] Field of Search ..... 252/8.6, 8.8, 155, 174.25

[56] References Cited

U.S. PATENT DOCUMENTS 4,472,287 9/1984 Ramachandran et al. ..... 252/174.25

4,488,972 12/1984 Weinstein ..... 252/174.25

4,497,715 2/1985 Bauman ..... 252/174.25

*Primary Examiner*—Lorenzo B. Hayes

*Assistant Examiner*—Willie J. Thompson

*Attorney, Agent, or Firm*—Herbert S. Sylvester; Murray M. Grill; Norman Blumenkopf

[57] ABSTRACT

A particulate fabric softening and antistatic built detergent composition includes synthetic organic detergent, builder for the detergent, bentonite and higher aliphatic isostearamide antistat. The bentonite and antistat are often preferably agglomerated together and may be admixed with spray dried detergent "base beads" which are preferably of similar particle sizes and which include anionic synthetic organic detergent and builder, to make the fabric softening and antistatic detergent composition. Also within the invention is a process for washing and drying laundry which produces laundry that is soft and static-free or of low electrostatic charge despite having been subjected to a tumble drying process which normally makes laundry of similar fabrics electrostatically charged and subject to objectionable "static cling".

18 Claims, No Drawings

PARTICULATE FABRIC SOFTENING AND ANTISTATIC BUILT DETERGENT COMPOSITION AND PARTICULATE AGGLOMERATE FOR USE IN MANUFACTURE THEREOF

This application is for a particulate detergent which incorporates an antistatic agent or agents described in U.S. patent application Ser. No. 674,194, of Robert A. Bauman (one of the present coinventors), filed Nov. 23, 1984, now U.S. Pat. No. 4,563,288, which is a continuation-in-part of U.S. patent application Ser. No. 404,794, filed Aug. 3, 1982, and issued as U.S. Pat. No. 4,497,715.

The present invention relates to detergent compositions. More particularly, it relates to particulate fabric softening and antistatic detergent compositions, preferably built detergent compositions, which include synthetic organic detergent, builder (preferably) for the detergent, bentonite and N-higher aliphatic isostearamide antistat. The bentonite and antistat are often preferably agglomerated together and such agglomerates may be mixed with spray dried or other suitable detergent "base beads" or compositions to make fabric softening and antistatic detergent compositions. Also within the invention is a process for washing and drying laundry which produces laundry that is soft and static-free or of low electrostatic charge despite having been subjected to a normal tumble drying operation.

Built synthetic organic detergent compositions are today the cleaning materials of choice for washing dirty laundry. Such compositions have been found to be exceptionally effective in laundering fabric items made from synthetic and/or natural fibrous materials, whether such have been stained with oily, protein or clay soils, which three soils are those most frequently encountered in home laundering, and which are fairly representative of soils normally occurring and present on usual dirty laundry. With the replacement of soap in washing compositions by synthetic organic detergents the softening effect of the soap (usually as an insoluble soap which deposited on the laundry fabric fibers) has been lost and especially in the presence of certain inorganic builder salts the laundry will often become unpleasant to the touch, rough and stiff (or boardy). For years it has been known that bentonite, when added to synthetic organic detergent compositions based on anionic detergents, could help to soften the laundry and thereby could make detergent compositions that were so modified acceptable to the consumer.

With the advent of synthetic polymeric fibers and clothing and other laundry items made from them and from blends of such synthetics with natural fibers, such as cotton/polyester blends, and with the increasing use of automatic laundry dryers, which are almost all of the tumble drying type, it was found that dried laundry often accumulated electrostatic charges that would cause it annoyingly to cling together, interfering with normal handling and with folding of the laundry for storage. Cationic compounds, such as quaternary ammonium salts, e.g., di-higher alkyl di-lower alkyl ammonium halides, have been known for years to be capable of acting as antistatic agents (antistats) to decrease static charges on fabric items and to prevent static cling. Such quaternary ammonium halides would normally be added in the rinse water during a washing cycle, and not in a detergent composition or in the wash water, because they react chemically with anionic detergents, which are the detergents most frequently employed in synthetic organic detergent compositions. Such reaction would diminish the detersive power of the detergent composition and could create undesirable reaction products which could deposit on the laundry being washed, creating dirty or greasy spotting. In recent years cationic compounds, such as the quaternary ammonium halides, have been formulated into built detergent compositions, such as particulate detergent compositions, in which they do not chemically react objectionably with the anionic detergents during storage but do react to some extent with them in the wash water. While such compositions exert an antistatic effect and diminish static cling of the washed laundry it has been noted that the detergency of the compositions in which they are present is inferior to that of the base composition without the antistat.

In the earlier "parent" CISA patent applications, previously referred to, were described the desirable antistatic activity of N-higher aliphatic isostearamides and it was mentioned that such could be combined with bentonite and employed with detergent compositions which would result in a wash water possessing both fabric softening and antistatic properties, so that laundry washed with it would be soft and free of objectionable static cling. The present application describes in detail detergent compositions containing both bentonite and isostearamide antistat, and describes the desirable effects obtained from them, which include washed laundry of satisfactory softness, little or no static cling, improved detergency, and no "quat spots". Additionally, no reductions in foaming power are noted after use of the invented compositions whereas when quaternary ammonium salts are employed as antistats, foam is diminished, apparently due to the reaction of the quaternary salt with the anionic detergent and inactivation of the detergent thereby. Furthermore, yellowing or similar discoloration of the laundry by the quaternary, and soil redeposition are diminished, compared to those resulting when a quaternary ammonium halide is utilized with an anionic detergent in other built detergent compositions.

In accordance with the present invention a particulate fabric softening and antistatic detergent composition comprises a detersive proportion of a synthetic organic detergent, a fabric softening proportion of bentonite and an antistatic proportion of higher aliphatic isostearamide antistat. Normally, the active detergent component of the described detergent composition will be an anionic detergent (which would be reactive with a quaternary ammonium salt), and the detergent composition will be a built composition, containing a detergent builder, such as sodium tripolyphosphate, sodium carbonate or sodium silicate, or other suitable builder, or mixture of such builders. In a preferred detergent composition the isostearamide and bentonite will be present as an agglomerate, with the particles thereof preferably being about the same size as the rest of the composition, which preferably will be in spray dried bead form. Such agglomerates are also within the invention, as are detergent compositions containing them, in which they function to make the compositions fabric softening and antistatic. If desired, the agglomerates or the components thereof may be added to the wash water before, after or together with the detergent composition.

The anionic synthetic organic detergent of the present detergent compositions will normally be sulfated and/or sulfonated lipophilic material(s) having an alkyl chain of 8 to 20 carbon atoms, preferably 10 to 18 and more preferably 12 to 16. While various water soluble salt-forming cations may be used to form the desired soluble sulfated and sulfonated detergents, including ammonium and lower alkanolamine (such as triethanolamine), and magnesium, usually an alkali metal, such as sodium or potassium, is employed, and very preferably such cation will be sodium. Among the various anionic detergents that are useful in the practice of this invention the linear higher alkylbenzene sulfonates with 10 to 18 carbon atoms making up the alkyl chain, preferably 12 to 16 and more preferably about 12 to 14, e.g., dodecyl and tridecyl, are considered most suitable. Also, useful, among others, are the monoglyceride sulfates, higher fatty alcohol sulfates, sulfated polyethoxylated higher alkanols, wherein such alkanols may be synthetic or natural, containing from 3 to 20 or 30 ethoxy groups per mole, paraffin sulfonates and olefin sulfonates, in all of which compounds the alkyl group present is of 10 to 18 carbon atoms. Some such alkyl groups may be slightly branched (not preferred) but will still be of a carbon chain length within the described range.

Although the linear higher alkylbenzene sulfonates, as the sodium salts, are the preferred anionic detergents utilized in the practice of the present invention, mixtures of such detergents with other linear higher alkylbenzene sulfonates containing different cations may be employed, as may be mixtures of such detergents with others, such as the fatty alcohol sulfates and sulfated polyethoxylated higher alkanols. In some instances only minor proportions of the linear alkylbenzene sulfonates will be present or the anionic synthetic organic detergent may be a mixture of other anionic detergents of the types described. Also, other anionic detergents may be employed, such as those which are well known in the art, which are described in various annual publications entitled *McCutcheon's Detergents and Emulsifiers,* for example, that which was issued in 1969.

While the present invention is primarily of anionic detergent compositions, which have antistatic properties, the desirable results mentioned herein are also obtainable with compositions containing other types of synthetic organic detergents with the anionic detergents, such as nonionic and amphoteric detergents. The mentioned nonionic and amphoteric materials are normally present in only minor proportions, if present at all, and usually only half as much thereof will be present, at the most, as of the synthetic anionic organic detergent. Preferred nonionic detergents are the ethylene oxide condensation products of higher fatty alcohols, such as condensation products of higher fatty alcohols of 12 to 18 carbon atoms with from 3 to 20 moles of ethylene oxide, preferably condensation products of higher fatty alcohols of 12 to 15 carbon atoms with 5 to 15 moles of ethylene oxide.

The detergent will preferably be built with a detergent builder so that it will have increased cleaning power and be suitable for "heavy duty" cleaning applications. Among useful builders for the present compositions are the polyphosphates such as sodium tripolyphosphate and tetrasodium pyrophosphate, sodium carbonate, sodium bicarbonate, sodium sesquicarbonate, sodium silicate ($Na_2O:SiO_2=1.6$ to 3.0, preferably 1:2.4, NTA, sodium citrate, sodium gluconate, borax, other borates, zeolites, polyacetal carboxylates and other useful builders known in the detergent art.

When zeolite builders are employed they will usually be of the formula $(Na_2O)_x.(Al_2O_3)_y.(SiO_2).w\ H_2O$, wherein x is 1, y is from 0.8 to 1.2, preferably about 1, z is from 1.5 to 3.5, preferably 2 to 3 or about 2, and w is from 0 to 9, preferably 2.5 to 6. Such zeolites are cation exchanging and have an exchange capacity for calcium ion in the range of about 200 to 400 or more milligram equivalents of calcium carbonate hardness per gram. They will very often be hydrated to the extent of 5 to 30%, preferably 10 to 25% moisture, e.g., about 20% thereof. Zeolite A is preferred (X and Y are also useful) and for such zeolite, type 4A is most preferred. Particle sizes of the zeolite(s) will usually be 100 to 400 mesh (or sieve number), preferably 140 or 200 to 325 mesh, but their ultimate sizes will be submicron. The various zeolites are described at length in the text *Zeolite Molecular Sieves,* by Donald W. Breck, published in 1974 by John Wiley & Sons, especially at pages 747–749 thereof.

When polyacetal carboxylates are present they may be considered to be those described in U.S. patent 4,144,226 and may be made by the method mentioned therein. A typical such product will be of the formula

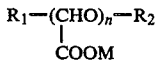

wherein M is selected from the group consisting of alkali metal, ammonium, alkyl groups of 1 to 4 carbon atoms, tetraalkylammonium groups and alkanolamine groups, which are of 1 to 4 carbon atoms in the alkyls thereof, n averages at least 4, and $R_1$ and $R_2$ are any chemically stable groups which stabilize the polymer against rapid depolymerization in alkaline solution. Preferably the polyacetal carboxylate will be one wherein M is alkali metal, e.g., sodium, n is from 20 to 200, $R_1$ is

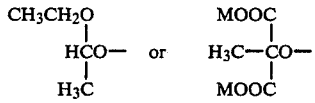

or a mixture thereof, $R_2$ is

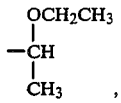

and n averages from 20 to 100, more preferably 30 to 80. The calculated weight average molecular weights of the polymers will normally be within the range of 2,000 to 20,000, preferably 3,500 to 10,000 and more preferably 5,000 to 9,000, e.g., about 8,000.

Although the preferred polyacetal carboxylates have been described it is to be understood, that they may be wholly or partially replaced by other such polyacetal carboxylates or related organic builder salts described in various Monsanto patents on such compounds, processes for the manufacture thereof and compositions in which they are employed. Also, the chain terminating groups described in the Monsanto patents referred to, especially U.S. Pat. No. 4,144,226, may be utilized, providing that they have the desired stabilizing properties, which allow the mentioned builders to be depolymerized in acidic media, facilitating biodegradation thereof in waste streams, but maintain their stability in alkaline media, such as washing solutions.

When it is desired to avoid the presence of phosphorus in the detergent composition polyphosphate builders may be omitted from the present formulations, in which case it is preferred to employ other non-phosphate builders, such as those mentioned herein. Combinations of zeolite and polyacetal carboxylate are very useful substitutes for the polyphosphate builders, and such combinations, with N-alkyl isostearamides in detergent compositions (but without bentonite), are described in an application for patent entitled *Antistatic Built Synthetic Organic Detergent Composition,* identified by Docket No. GMF-3 and filed by Gary M. Freeman in early December, 1984. The sodium salts of such builders are preferably employed but alkali metal and other soluble salts may be at least partially substituted for them.

Fillers may be present, such as sodium sulfate (preferred) and sodium chloride, to add bulk to the product and electrolyte to the wash water when such are considered to be desirable, and they may also serve other functional purposes.

The antistatic agent of choice in the practice of the present invention is N-cocoisostearamide. Such antistatic agent is an amide which is chemically derivable from isostearic acid and cocoamine by the condensation reaction shown below:

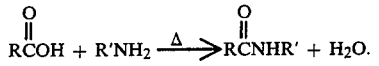

$$\overset{O}{\overset{\|}{R}}COH + R'NH_2 \xrightarrow{\Delta} \overset{O}{\overset{\|}{R}}CNHR' + H_2O.$$

Isostearic acid,

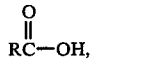

$$\overset{O}{\overset{\|}{R}}C{-}OH,$$

is a saturated fatty acid of the formula $C_{17}H_{35}COOH$, which is a complex mixture of isomers, primarily of the methyl-branched series, that are mutually soluble and virtually inseparable. While such acid normally has uses similar to those of stearic or oleic acids, it is considered that it is far superior to such materials in manufacturing effective antistatic agents, which are suitable for incorporation in applicant's synthetic organic anionic detergent compositions. Cocoamine is an aliphatic amine in which the aliphatic group is derived from coconut oil. Other primary aliphatic amines, preferably higher alkylamines of 7 to 18 carbon atoms in the alkyl, such as $R'NH_2$, wherein R' is such a higher alkyl, may also be used, but cocoamine produces an isostearamide (CISA) of the best properties for incorporation in detergent compositions.

While CISA is the most highly preferred antistatic agent (such may be referred to as antistats) it is within the broader aspects of this invention to employ other N-aliphatic isostearamides, such as those derived from primary aliphatic amines containing up to 20 carbon atoms, preferably 7–18 carbon atoms, the aliphatic parts of which may or may not be hydrogenated, provided that the amides made have sufficient antistatic effect in the described use. Some examples thereof are the N-alkylisostearamides of 7 to 18 carbon atoms, such as N-decylamine, N-octylamine and those derived from N-tallowamine. However, it is considered that CISA is the best of the N-alkylisostearamides in antistatic activity and therefore when the other isostearamides are used,such use will preferably be with CISA, and the proportion of other isostearamide will preferably be minor, with respect to the CISA. In some cases the hydrogen atom om the amide nitrogen may be replaced by suitable radicals, such as lower alkyl, e.g., methyl, providing that a desired antistatic effect is still obtained, but it has been found that the tertiary isostearamides usually are of little antistatic activity.

The bentonite utilized is preferably a Wyoming or western bentonite having a swelling capacity in the range of 3 to 15 ml./gram, preferably 7 to 15 ml./g., and its viscosity, at a 6% concentration in water, will usually be in the range of 3 to 30 centipoises, preferably 8 to 30 centipoises. Useful swelling bentonites of this type are sold under the trademark Mineral Colloid, as industrial bentonite, by Benton Clay Company, an affiliate of Georgia Kaolin Co. Such materials were formerly marketed under the trademark THIXO-JEL by such company. They are selectively mined and beneficiated bentonites, and those considered to be most useful are available as Mineral Colloid 101, etc., and correspond to those formerly sold as THIXO-JEL's No's. 1, 2, 3 and 4. These materials have pH's (6% concentration in water) in the range of 8 to 9.4, maximum free moisture contents of about 8% and specific gravities of about 2.6, and for the pulverized grade about 85% passes through a 200 mesh U.S. Sieve Series sieve. Equivalent to such bentonite is that sold as Bentonite Clay AEG 325 by American Colloid Co., which is essentially of No. 325 sieve size (U.S. Sieve Series).

Beneficiated Wyoming bentonite is preferred as a component of the present compositions but other bentonites are also useful, especially when they form only a minor proportion of the bentonite used. Although it is desirable to limit maximum free moisture content, as mentioned, it is more important to make certain that the bentonite being employed includes enough moisture, most of which is considered to be present between adjacent plates of the bentonite, to facilitate quick disintegration of the bentonite and any adjacent materials in the particles when such particles or detergent compositions containing them are brought into contact with water, such as when the detergent composition is added to the wash water. It has been found that at least about 2%, preferably at least 4%, and most preferably 5% or more, to about 8%, of water should be present in the bentonite initially, before it is admixed with other bead components in the crutcher and before it is agglomerated with CISA or other isostearamide, and such a proportion of moisture should also be present after spray drying or after other processing. It has been established that overdrying to the point where the bentonite loses its "internal" moisture can significantly diminish the fabric softening utility of the present compositions. When the bentonite moisture content is too low the bentonite does not act to the extent that is possible to prevent any objectionable silicate-zeolite agglomerates being formed in wash water and it also does not aid enough in disintegrating the beads in the wash water. Also, when the bentonite is of satisfactory moisture content it exerts a calcium and magnesium exchange function, which is often desirable.

Among the various adjuvants that may be present in the subject compositions are colorants, such as dyes and pigments, perfumes, enzymes, stabilizers, activators, fluorescent brighteners, bleaches, buffers, fungicides, germicides, antifoams and flow promoting agents. Also included among adjuvants, builders and fillers, unless in other classes that are mentioned, are various additional components or impurities present in the components of the compositions. For example, it is known that sodium carbonate and water are often present with polyacetal carboxylate in Builder U, the product which is the present source of polyacetal carboxylate.

Moisture will usually be present in the invented compositions, either as free moisture or in one or more hydrates. While moisture is not an essential component of the present particulate solid detergent compositions it will normally be present due to the use of water in manufacturing, and it may help to solubilize composition components and help to bind them together. Other binding means may be used to make the CISA-bentonite agglomerates but usually water or aqueous solutions of binder will be employed,and so water will be present in such compositions.

Proportions of the essential components of the detergent compositions are such as to make them operative for the intended purposes of the composition. Thus, the synthetic organic detergent will be present in a detersive proportion, the bentonite will be present in a fabric softening proportion and the higher aliphatic isostearamide antistat will be present in an antistatic proportion. When the builder is present, as it is in most detergent compositions of this invention, it will be present in a detergent building proportion. The proportions described will normally be 5 to 30% of the detergent, such as sodium linear higher alkylbenzene sulfonate, preferably 5 to 20% thereof and more preferably about 15% thereof, and the builder for the detergent, which may be a mixture of builders, will normally be 5 to 85% of the composition, often preferably being a combination of 20 to 40% of sodium tripolyphosphate, 3 to 15% of sodium carbonate and 2 to 12% of sodium silicate, and more preferably often being a combination of about 33% of sodium tripolyphosphate, about 5% of sodium carbonate and about 7% of sodium silicate. The bentonite component will normally be 4 to 25% of the detergent composition, preferably being 5 to 22% thereof and more preferably being about 20% thereof, with the isostearamide antistat normally being 1 to 20% of the composition, preferably being 1 to 10% thereof and more preferably being about 5% thereof. The moisture content of the composition will usually be in the range of 5 to 20%, preferably being from 7 to 15% and more preferably being about 10% thereof.

In the particulate fabric softening antistatic product intended for addition to detergent compositions to impart fabric softening antistatic properties to them, the bentonite will be present in a fabric softening proportion and the antistat will be present in such proportion that when the preferably agglomerated product is added to a particulate built detergent product, laundry washed with the resulting improved detergent composition will be staticfree or of little capability of generating electrostatic charges under normal drying and use conditions. In such agglomerated particulate products the bentonite will normally be from 5 to 95%, preferably being 25 to 90% and more preferably being about 75 to 80%, and the isostearamide antistat will normally be from 5 to 50%, preferably 10 to 40% and more preferably about 15 to 20%. As was previously mentioned, the detergent composition may contain adjuvants and moisture, and so also may the agglomerate or other suitable mixture of bentonite and antistat. Normally the total of bentonite and antistat in the combination thereof will be at least 75% thereof and often it will be preferable for no adjuvants to be present. The moisture content of the agglomerate will generally be in the range of 1 to 15%, preferably being from 3 to 10%, e.g., 7%. In both the agglomerate and the final detergent composition the ratio of bentonite to antistat will usually be about the same, normally being in the range of one part of antistat to from 1 or 2 to 10 or 20 parts of bentonite, preferably being in the range of 1:3 to 7, and more preferably being about 1:4.

Both the agglomerate and the detergent (base beads) are preferably of about the same particle sizes, usually being in the range of 8 to 140, preferably 10 to 100, U.S. Sieve Series, because when the particle sizes are about the same and the bulk density is about the same (and in both such cases the bulk density will be in the range of 0.2 to 0.8 g./c. cm., preferably being about 0.3 to 0.5 g./c. cm.) the different beads do not segregate before use, but even when finely divided bentonite is mixed with detergent base beads, after which the antistat in liquid form is sprayed onto such mixture, particles in about the same particle size range are obtainable (if oversized particles are produced they may be screened out) and are satisfactorily free flowing, non-segregating on transportation and storage, and non-caking. In the event that the presence of the antistat increases tackiness of the detergent and decreases flowability, finely divided lubricant powders, such as calcium silicate, magnesium silicate or talc, in small proportions (normally less than 1%), may be mixed with the composition, but when such additions are unnecessary they will normally be avoided.

Instead of making the fabric softener-antistat additive and admixing it with previously made detergent base beads, one or more of the components of such additive may be mixed with components of the base beads in a "dry mix" or, when suitable, may be mixed with other components of the detergent composition in a detergent crutcher, after which they may be spray dried to particulate form. Alternatively, either the fabric softener or the antistat, when sufficiently stable, may be incorporated in the crutcher mix for spray drying with the detergent base beads and the other of such components may be post-added. Such post-added material may be a bentonite agglomerate of approximately the same particle sizes as the spray dried detergent base beads or it can be a suitable agglomerate of the antistat on a suitable carrier, such as other smectites, other clays, sodium sulfate, builder salt, silica or a mixture thereof. However, in the case of the antistat, it will normally be preferred to spray it in liquid form onto a moving bed or falling curtain of a particulate composition of the other components of the product. Such spray will preferably be very finely divided, often including micron- and sub-micron-sized particles but in some instances it may even be dripped onto a moving bed of base beads, such as in a tumbling drum or in a fluidized bed apparatus. Alternatively, the antistat may be dissolved in a volatile solvent and sprayed onto moving particles containing the remainder of the composition, after which the volatile solvent may be withdrawn by use of heat and/or vacuum.

In a normal contemplated use of the invention the agglomerate of bentonite and antistat, or such materials in other suitable physical form, e.g., powders, will be added by the manufacturer to normal production of a desired detergent composition. The use of such additive allows for the use of manufacturing spray towers to produce a limited number of basic detergent compositions, any of which may be modified readily by the addition of the desired proportion of the agglomerate. Thus, the use of the invented agglomerate gives the detergent manufacturer greater manufacturing flexibility, and in effect, increases plant efficiency and the capacity to make a variety of different detergent products. The agglomerating equipment and post-mixing equipment employed to make the products of the present invention are already in use in many detergent plants, especially those equipped for the post-addition of bentonite agglomerates to detergent compositions, and those used to make built nonionic synthetic organic detergents. If plant capacity is not a problem, then, as was previously described, different formulations may be spray dried and selected components may be post-added (sometimes in conjunction with already existing equipment used to perfume the product and to add flow improving agents to it), if desired.

Instead of the manufacturer adding the bentonite and antistat to base beads, the homemaker may add the agglomerate or its components to the washing machine with the detergent composition. This mode of the invention allows the homemaker to regulate the proportion of softness and antistatic action to be obtained.

Various advantages of the invention, many of which were previously alluded to, will be clearly illustrated in the working examples, which follow. Thus, using an agglomerate of bentonite and isostearamide antistat, one can admix it with different detergent compositions to make them capable of softening fabrics, while maintaining such fabrics static free and preventing static cling. By varying the proportions of bentonite and antistat in the additive the final detergent composition may be custom "tailored" to impart desired amounts of fabric softening and antistatic properties to the final detergent composition, as may be dependent on the composition of the base detergent composition to which the agglomerate is to be added. The isostearamide antistat does not react objectionably with the bentonite nor does it so react with anionic detergent, and therefore, compositions of this invention are stable on storage and do not lose significant proportions of their desired properties on storage or in use. Unlike the usual currently employed cationic fabric softeners and antistatic agents, such as quaternary ammonium salts, the present compositions do not deposit reaction products of such cationic materials and anionic detergents onto laundry being washed, so such laundry is not as subject to soil deposition during the washing process. It has been found that the invented detergent compositions produce whiter laundry and less soil redeposition, too, whereas laundry washed with compositions containing anionic detergent and quaternary ammonium salt (in antistat and in fabric softener proportions) tend to become yellower, especially on repeated washings. Detergency is measurably better when the present compositions are employed than when those are used in which a quaternary ammonium salt is present instead of the isostearamide. Also, interference with the foaming power of the anionic detergent, usually noted when quaternary ammonium salts are present, and reaction of such "quats" with fluorescent brighteners, and resulting diminished brightening of laundry, are avoided when the present antistats are used. It is evident that the present invention represents a significant improvement in the detergent art, wherein today it is important that detergent compositions possess fabric softening and antistatic properties.

Washing of laundry with the described detergent compositions and with wash water containing the components of such compositions is easily effected in accordance with normal laundry procedures, and standard equipment and normal washing concentrations of the detergent composition may be employed and will result in a clean wash which is soft to the touch and does not exhibit objectionable static cling, even when substantial proportions of synthetics, such as polyesters, e.g., Dacron® and polyamides, e.g., nylons, are present. The wash water employed may be usual city water and the present detergent compositions are effective even when the hardness is as high as 300 p.p.m., as calcium carbonate, and sometimes even higher. Normally the water hardness is of mixed magnesium and calcium ions hardness, usually with the major proportion being from calcium. Preferably the wash water will be of a hardness no greater than 250 p.p.m. and usually city waters employed will have hardnesses from 20 to 150 or 200 p.p.m., e.g., about 50 or 100 p.p.m. The present compositions may be used with wash water at any of various temperatures, and are effective even with wash waters at lower temperatures, such as about room temperature. Following European practice, the compositions may be used in wash waters at temperatures approaching boiling, e.g., 70° to 95° C., but in usual American practice lower temperatures are utilized. Especially good results are obtained, in American washing practice, by employing the present compositions in wash waters at temperatures in the range of 10° to 50° C., preferably 30° to 50° C., e.g., about 40° C. The concentration of the detergent composition in the wash water may be varied, depending on circumstances, but normally will be in the range of 0.05 to 0.5% by weight, preferably 0.05 to 0.3% and more preferably about 0.1 to 0.2%, e.g., about 0.15%.

Standard home laundry washing machines and the normal wash cycles of such machines may be used, or industrial or commercial washing machines may be employed. For home laundry use, generally the normal weight of laundry charged is 2.7 to 4.5 kg., e.g., 3.6 kg. and such is charged to a washing machine containing about 65 liters of wash water at normal washing temperature, e.g., 40° C. Washing of the laundry is effected in a normal cycle over a period of about 2 to 30 minutes, such as 5 to 20 minutes, e.g., about 10 minutes, usually depending on the dirtiness of the laundry and the nature of the fabric. After completion of the washing cycle the laundry is automatically rinsed, and is subsequently dried in an automatic laundry dryer, in which it is tumbled while being subjected to the passage of drying air through it.

The following examples illustrate but do not limit the invention. Unless otherwise indicated, all parts are by weight and all temperatures are in °C. in the examples, in the specification, and in the appended claims.

EXAMPLE 1

| Component | Percent |
|---|---|
| Sodium linear tridecylbenzene sulfonate | 15.0 |
| Sodium tripolyphosphate | 33.0 |
| Sodium carbonate | 5.0 |
| Optical brightener (Tinopal 5BM, CIBA-GEIGY) | 0.3 |
| Sodium carboxymethyl cellulose | 0.3 |
| Perfume | 0.2 |
| Sodium silicate ($Na_2O:SiO_2$ = 1:2.4) | 7.0 |
| Moisture | 10.0 |
| Bentonite (American Colloid AEG 325) | 20.0 |
| N—cocoalkyl isostearamide | 5.0 |
| Sodium sulfate | 4.2 |

-continued

| Component | Percent |
|---|---|
| | 100.0 |

The above formula for a product of this invention is utilized for the manufacture of a particulate product in the form of spray dried beads, which are made by spray drying an aqueous crutcher mix of the formula, employing normal spray tower drying procedures. The crutcher mix is of a solids content of about 60% and is spray dried in a conventional countercurrent spray tower, with the drying air inlet temperature being at about 400° C. and with the outlet air being at a temperature of about 250° C. The invented product resulting is of particle sizes in the No's. 10 to 100 range, U.S. Sieve Series, and if outside this range may be screened to produce such sizes. The bulk density of the product is about 0.4 g./c. cm.

The particulate detergent composition of the invention made by the described process, is tested for detergency, softening capability and static charge inhibition (on washed and dried laundry). Compared to a control, in which the bentonite and isostearamide antistat are omitted from the formula, with the proportions thereof being replaced by sodium sulfate, detergency is the same, softening capability is much better for the invented product and static inhibition is also greater for such product. Detergency is measured by noting the improvement in reflectance of a mixture of soiled swatches of various materials, soiled or stained with various test soils and stains, after washings with the inverted and control formulas. For this test and for redeposition tests the optical brightener is preferably omitted from both control and invented formulas so that its presence will not interfere with reflectance readings. Softness is measured by washings of test toweling with the invented and control formulas and then evaluating the washed and dried towels for softness, on a scale of 1 to 10, (the higher numbers indicating greater softnesses). In such evaluation the control is rated 1 and the invented product is rated 10, which is the maximum improvement possible. Antistatic capability (the ability to lower electrostatic charge pick-up by washed and dried laundry) is evaluated by washing a variety of materials, including synthetic polymeric fibrous materials and natural fibrous materials separately with the control and invented products, and noting the presence or absence of "static cling" on such materials after washing in an automatic washing machine and drying in an automatic laundry dryer, of the tumbling type. To obtain quantitative indications of static cling or electrostatic charges on washed and dried laundry, swatches of various materials, including, cotton-polyester, polyester, acetate and polyamide (nylon) are rubbed in a controlled manner with wool, under controlled conditions, at 25–30% relative humidity, after being washed in a test wash water and dried. Then, the electrostatic charges on the swatches are measured, the measured electrostatic charges, in kilovolts, are averaged for each material, the averages are then totalled to obtain "static indices" and the indices for the control and experimental formulas may then be compared. Of course, the better detergent compositions, with respect to static cling inhibition, are those for which the static indices are lower. Using the described quantitative testing procedure the static index for the experimental formula is 24 and that for the control is 52, proving substantial improvement.

In other tests made the extent of redeposition of soil on the washed laundry is found to be about the same with the invented product as with a second control product, which is like the given invented formula except for replacement of the N-alkyl isostearamide with sodium sulfate, and such redeposition is more for a third control detergent composition, like the invented composition except for the replacement of the isostearamide with the same proportion of dimethyldistearyl ammonium chloride.

The test cloths and laundry washed with the invented product show no "quat-spotting", which sometimes is noted on laundry washed with similar formulas containing dimethyldistearyl ammonium chloride or other quaternary compound instead of the isostearamide antistat. Also, the optical brightening effect for the invented product containing isostearamide is greater than that for a similar product, in the formula of which the isostearamide is replaced by dimethyldistearyl ammonium chloride or other such antistatic quaternary ammonium halide.

When, in the formula of the invented product given, the 5% of N-cocoalkyl isostearamide is replaced by 1%, 3% and 7%, respectively, of such isostearamide, the softness evaluations of the products resulting are 8, 10 and 10, respectively, and the static indices are 35, 31 and 19, respectively. Softness indices of 8 or above are considered satisfactory, and static indices of less than 35 are often found to be acceptable. When the product of the formula of this invention, given above, is tested against commercial fabric softening and antistatic particulate detergent compositions, based on anionic detergent plus quat, it is found to be comparable to them as a fabric softener-antistat (being better in softening and not as good in antistatic properties), but it is a better detergent because anionic-quat interaction is avoided.

When in practical laundry tests the first control and invented compositions are compared, it is found that the control does not satisfactorily soften laundry and produces high electrostatic charges and objectionable static cling. When bentonite is omitted from the invented composition formula the detergent compositions are unsatisfactory with respect to softening power, even when a high proportion of the isostearamide is present. When the isostearamide is omitted static cling is still objectionable, despite the presence of 20% of the bentonite. Thus, it is seen that the combination of bentonite and N-higher alkyl isostearamide is important to the success of the present laundry detergent compositions because both fabric softening and antistatic (anti-cling) properties are now required of detergent compositions by discriminating consumers.

Instead of the preferred N-cocoalkyl isostearamide other higher aliphatic isostearamides, preferably higher primary aliphatic isostearamides, and more preferably higher primary N-alkyl isostearamides, may be utilized, such as N-n-octyl isostearamide, N-n-decyl isostearamide, N-n-heptyl isostearamide, N-n-dodecyl isostearamide, N-n-tetradecyl isostearamide and N-primary hydrogenated tallow isostearamide.

When the bentonite content of the lead formula given is modified within the 4 to 25% range, as to 10%, 15% and 24%, useful softening and antistatic detergent compositions result, and even when the bentonite content is decreased to 7% noticeable fabric softening is obtainable. Similarly, changes in the proportion of anionic detergent may be made within the range of 5 to 30%, e.g., 10%, 20% and 25%, and the total proportion of builder salt may be varied within the 5 to 85% range, e.g., to 25, 50 and 75%, and effective softening and antistatic detergent compositions can result. The bentonite utilized may be changed to any of the other types of bentonite mentioned previously in the specification, and sometimes other useful swelling clays, such as other montmorillonites may be used, but usually it will be preferable to employ western or Wyoming type of bentonite. The sodium linear tridecylbenzene sulfonate may be replaced either in whole or in part by sodium linear dodecylbenzene sulfonate or other linear higher alkylbenzene sulfonate of 10 to 15 or 18 carbon atoms or with other anionic detergent, such as sodium lauryl sulfate, sodium cetyl sulfate, sodium paraffin sulfonate, wherein the paraffin is of about 16 carbon atoms, sodium dodecyl triethoxy sulfate and/or sodium cocomonoglyceride sulfate, or any of various mixtures thereof. Sometimes it may also be desirable to have present a minor proportion of nonionic detergent, such as Neodol® 45-11 or 25-7, both of which are condensation products of higher fatty alcohols and ethylene oxide.

In the described variations, within the invention, of the preferred lead formula the products obtained are useful fabric softening and antistatic detergent compositions and are superior, in the properties previously described, to formulations from which the bentonite and isostearamide have been omitted and from formulations in which quaternary ammonium salts are employed instead of the isostearamide.

EXAMPLE 2

Instead of manufacturing spray dried beads from the crutcher mixes of all the components of the preferred formula of Example 1 a detergent composition is made from such components less the bentonite and isostearamide and there is mixed with it an agglomerate of the isostearamide and bentonite, with the end result being a particulate composition of the same formula as that given in Example 1. Such product is a satisfactory fabric softening and antistatic heavy duty laundry detergent composition of properties essentially the same as those described for the product of the same formula in Example 1. Similarly, variations in such formula like those described in Example 1 can be made wherein the agglomerated bentonite-isostearamide additive is mixed with the detergent "base beads" to make the final product, and the properties of such products will be like those described for the variations of the invention of Example 1. Also, such agglomerates may be used directly as rinse cycle softstats.

The bentonite-isostearamide agglomerates may be made by any of various suitable methods, with a preferred method being to mix the components together, sometimes with minor adjuvants, and then to agglomerate them in a suitable apparatus, sometimes with the aid of a binding agent but more preferably, using only water, if that is needed, in the agglomeration operation. Among suitable binding agents that may be mentioned are sodium carboxymethyl cellulose, sodium silicate and/or sodium sulfate, all of which are normal components of detergent compositions, and therefore do not add any unacceptable constituents to the product formula The isostearamide may be heated to its liquefaction point and may then be sprayed onto moving surfaces of the bentonite, as in a twin shell blender, a V-blender, a rotating inclined drum, a fluidized bead apparatus, or other suitable agglomerator, and in some cases the molten isostearamide may be dripped, rather than sprayed, onto moving surfaces of the bentonite. Sometimes the isostearamide may be dissolved or dispersed in a solvent, e.g., ethanol or a suitable dispersing medium, and may be sprayed or otherwise applied to the moving surfaces of the bentonite. A binding agent, dissolved or dispersed in a liquid medium, such as water, may be cosprayed onto such surfaces with the isostearamide or solution or dispersion thereof or in conjunction with it. The agglomeration process may be controlled, in known manner, to regulate the particle sizes and bulk density of the agglomerate being produced. If the particle sizes are outside the desired ranges, such as outside the No's. 10 to 100, U.S. Sieve Series, range, they may be screened or otherwise classified to the desired sizes. Usually, the bulk density will be approximately that of the spray dried beads, which will normally be within the 0.2 to 0.9 g./cc. range, e.g. 0.3 to 0.7.

After manufacture of the agglomerate and the spray dried detergent beads such components of the desired final product will be mixed or blended together by any suitable mixing or blending apparatus in the desired proportions, and a final product of desired characteristics will result.

While it is often preferred to make the compositions of this invention from agglomerates of the bentonite and isostearamide mixed with spray dried detergent beads or to spray dry the entire composition, other variations of the manufacturing method may also be employed. Thus, detergent base beads can be spray dried from a crutcher mix containing some or all of the bentonite component, and the N-substituted isostearamide, in liquid form, may be sprayed onto or otherwise applied to the surfaces of such beads. Conversely, the detergent base beads can be spray dried from a crutcher mix containing some or all of the N-substituted isostearamide and pre-agglomerated bentonite may be blended with them, sometimes with additional N-substituted isostearamide being sprayed onto the moving surfaces of the mixture. Instead of utilizing bentonite in agglomerated form it may be applied as a finely divided powder, with the particle size thereof normally being less than No. 200, U.S. Sieve Series, e.g., within the range of No's. 200 to 400. The N-substituted primary alkyl isostearamide may be applied together with another suitable carrier material, such as sodium sulfate, which, apart from its function as a carrier, preferably is one of the usual components of the preferred composition.

The various compositions herein described within the scope of this invention, as described in the foregoing specification, will be satisfactory synthetic organic detergent compositions which possess useful fabric softening and antistatic properties, so that laundry washed with such compositions will be satisfactorily soft to touch and items will not cling together objectionably after drying in a conventional tumble-type laundry dryer.

EXAMPLE 3

The composition of the formula of Example 1 is used to wash a standard load of laundry in a conventional General Electric top loading home laundry washing machine. Alternatively, the formula proportion of detergent composition base beads is added to the wash water, followed by separate additions of bentonite powder and N-cocoalkyl isostearamide (which may be dispersed in, dissolved in or blended with a suitable liquid medium or particulate carrier). The machine is filled with 65 liters of city water of a hardness of about 100 p.p.m., as calcium carbonate, of mixed magnesium and calcium hardness, with the calcium hardness being the major hardness. The wash water is at a temperature of 40° C. and the charge of dirty laundry to the wash water is about 3.6 kilograms. The laundry washed is made of cotton, mixed cotton-polyester, and polyamide (nylon), and is soiled with normal soils. Washing is continued over a period of ten minutes, after which the laundry is automatically rinsed and spin dried. It is then dried in an automatic laundry dryer, in which it is tumbled while being subjected to the passage of hot dry air through it. After drying, the laundry is evaluated by a panel of trained evaluators and is found to be satisfactorily clean, soft to the touch and free of annoying static cling. When a control detergent composition, which does not contain bentonite or the N-substituted isostearamide in its formula, is similarly used to wash similar laundry its cleaning power is satisfactory but the laundry is noticeably harsh in feel and is subject to static cling, with the static cling being especially noticeable for the laundry items which include synthetic polymer fibers in the fabrics thereof.

EXAMPLE 4

The agglomerate of Example 2, of the formula amounts or proportions of Example 1 for the bentonite and isostearamide, is made, as described in Example 2. Alternatively, a mixture of the two mentioned components in unagglomerated form may be made, as by spraying onto the surfaces of the bentonite powder an alcoholic solution of the isostearamide, followed by evaporation of the alcohol.

The agglomerate, or alternatively, the mixture, is then used as a rinse cycle treatment for washed laundry that is subsequently to be dried in an automatic laundry dryer. The concentration of the particulate softstat in the rinse water is about ¼ of that of the detergent composition that may be used to wash laundry, because the concentrations of the softener and the antistat are correspondingly greater. Thus, the concentration in the rinse water will often be in the range of 0.01 to 0.1%, preferably being in the range of 0.02 to 0.5%. However, the concentration employed will be an effective softening and antistatic concentration for the laundry being treated. Normally the rinse water will be of a hardness in the 50 to 250 p.p.m. hardness range and will be of a temperature in the 10° to 40° range.

The invention has been described with respect to various illustrations and embodiments thereof but is not to be limited to these because it is evident that one of skill in the art, with the present specification before him or her, will be able to utilize substitutes and equivalents without departing from the invention.

What is claimed is:

1. A particulate fabric softening antistatic product for addition to detergent compositions to impart fabric softening and antistatic properties to them, which comprises agglomerated particles of fabric softening bentonite and higher aliphatic isostearamide antistat.

2. A particulate product according to claim 1 wherein the fabric softening antistat particles are of sizes in the range of No's. 8 to 140, U.S. Sieve Series.

3. A product according to claim 2 wherein the agglomerated particles are of sizes in the range of No's. 10 to 100, U.S. Sieve Series and comprise from 5 to 95% of bentonite and 5 to 50% of higher aliphatic isostearamide in which the higher aliphatic is a primary hydrocarbon chain containing 7 to 18 carbon atoms.

4. A product according to claim 3 wherein the total percentage of bentonite and isostearamide is at least 75%, the proportion of bentonite to isostearamide is in the range of 10:1 to 1:1 and the isostearamide is cocoalkyl isostearamide.

5. A particulate detergent composition comprising a detersive proportion of a synthetic organic detergent, in particulate form, and a fabric softening and antistatic characteristic imparting proportion of a product of claim 1.

6. A detergent composition according to claim 5 wherein the detergent is a synthetic organic detergent of the sulfate or sulfonate type and which detergent composition contains a detergent building proportion of a detergent builder selected from the group consisting of polyphosphate, carbonate, bicarbonate, sesquicarbonate, silicate, zeolite, citrate, nitrilotriacetate and polyacetal carboxylate builders, and mixtures thereof, and which detergent and builder are in spray dried beads of particle sizes in the No's. 8 to 140 range, U.S. Sieve Series.

7. A detergent composition according to claim 6 which comprises about 5 to 30% of sodium linear higher alkylbenzene sulfonate, about 5 to 85% of builder, about 4 to 25% of bentonite, about 1 to 20% of isostearamide, about 3 to 15% of moisture and the balance, if any, of filler(s) and/or adjuvant(s), with the particles of the detergent composition being in the No's. 10 to 100 range, U.S. Sieve Series.

8. A detergent composition according to claim 7 wherein the detergent is sodium linear alkylbenzene sulfonate in which the alkyl is of 12 to 14 carbon atoms, the builder is a mixture of sodium tripolyphosphate, sodium carbonate and sodium silicate and the proportions of the components of the detergent composition are 10 to 20% of sodium linear alkylbenzene sulfonate, 20 to 40% of sodium tripolyphosphate, 3 to 15% of sodium carbonate, 2 to 12% of sodium silicate, 5 to 22% of bentonite and 1 to 10% of higher aliphatic isostearamide in which the higher aliphatic group is a primary hydrocarbon chain containing 7 to 18 carbon atoms.

9. A particulate fabric softening and antistatic detergent composition which comprises a detersive proportion of a synthetic organic detergent, a fabric softening proportion of bentonite and an antistatic proportion of a higher aliphatic isostearamide antistat.

10. A detergent composition according to claim 9 wherein the detergent is a synthetic organic detergent of the sulfate or sulfonate type and which composition contains a detergent building proportion of a detergent builder.

11. A detergent composition according to claim 10 wherein the detergent builder is selected from the group consisting of polyphosphate, carbonate, bicarbonate, sesquicarbonate, silicate, zeolite, citrate, nitrilotriacetate and polyacetal carboxylate builders, and mixtures thereof.

12. A detergent composition according to claim 11 of particle sizes in the range of 8 to 140, U.S. Sieve Series, and a bulk density in the range of 0.2 to 0.9 g./cc., which comprises about 5 to 30% of sodium linear higher alkylbenzene sulfonate, 5 to 85% of builder, 4 to 25% of bentonite, 1 to 20% of isostearamide, 3 to 15% of moisture and the balance, if any, of filler(s) and/or adjuvant(s).

13. A detergent composition according to claim 12, of particle sizes in the range of No's. 10 to 100, U.S. Sieve Series, and a bulk density in the range of 0.3 to 0.7 g./cc., wherein the detergent is sodium linear alkylbenzene sulfonate in which the alkyl is of 12 to 14 carbon atoms, the builder is a mixture of sodium tripolyphosphate, sodium carbonate and sodium silicate and the proportions of the components of the detergent composition are 5 to 20% of sodium linear alkylbenzene sulfonate, 20 to 40% of sodium tripolyphosphate, 3 to 15% of sodium carbonate, 2 to 12% of sodium silicate, 5 to 22% of bentonite and 1 to 10% of higher aliphatic isostearamide in which the higher aliphatic group is a primary hydrocarbon chain containing 7 to 18 carbon atoms.

14. A process for washing laundry and simultaneously softening it and lowering its capacity to generate and/or hold an electrostatic charge, which comprises washing the laundry in an aqueous medium contain a detersive proportion of a composition according to claim 9, rinsing the laundry and drying it in an automatic laundry dryer.

15. A process according to claim 14 wherein the detergent composition is according to claim 12 and the concentration thereof in the wash water is in the range of 0.05 to 0.5%.

16. A process according to claim 15 wherein the detergent composition is according to claim 13, the water temperature is in the range of 10° to 90° C. and the water is of a hardness up to 300 p.p.m., as calcium carbonate.

17. A process according to claim 16 wherein the water temperature is in the range of 30° to 50° C. and the concentration of the detergent composition in the wash water is in the range of 0.1 to 0.2%.

18. A process for treating laundry to soften it and lower its capacity to generate and/or hold an electrostatic charge, which comprises treating the laundry in a rinsing operation with a rinse water to which an antistatic proportion of N-higher aliphatic isostearamide and a fabric softening proportion of bentonite have been added, in particulate form, so the total concentration of such materials is in the range of 0.01 to 0.1% in the rinse water, and the bentonite is 5 to 95% of the total and the isostearamide is 5 to 50% thereof.

* * * * *